US005865118A

United States Patent [19]

Fromson et al.

[11] Patent Number: 5,865,118

[45] Date of Patent: Feb. 2, 1999

[54] METHOD AND APPARATUS FOR PUNCHING AND IMAGING A CONTINUOUS WEB

[75] Inventors: Howard A. Fromson, 49 Main St., Stonington, Conn. 06378; William J. Rozell, Vernon, Conn.; Paul C. Schunk, East Longmeadow, Mass.

[73] Assignee: Howard A. Fromson, Stonington, Conn.

[21] Appl. No.: 41,615

[22] Filed: Mar. 12, 1998

[51] Int. Cl.[6] ..... B41C 1/10; B41J 2/435

[52] U.S. Cl. ..... 101/463.1; 101/477; 101/485; 347/262

[58] Field of Search ..... 101/401.1, 463.1, 101/465–467, 477, 485, 486, DIG. 36; 347/116, 248, 262, 264; 430/204, 300, 302; 355/85, 86, 91, 94, 97, 104, 108, 111, 117

[56] References Cited

U.S. PATENT DOCUMENTS

| | | | |
|---|---|---|---|
| 3,848,998 | 11/1974 | Yonekura et al. | 355/85 |
| 4,092,925 | 6/1978 | Fromson | 101/401.1 |
| 4,419,009 | 12/1983 | Nakamura et al. | 355/103 |
| 5,094,933 | 3/1992 | Uhrig | 101/467 |
| 5,165,062 | 11/1992 | Ogura et al. | 355/85 |
| 5,255,607 | 10/1993 | Nishiyama et al. | 101/463.1 |
| 5,345,870 | 9/1994 | Bailey et al. | 101/463.1 |
| 5,508,730 | 4/1996 | Klein | 347/264 |
| 5,579,092 | 11/1996 | Isobe et al. | 347/116 |
| 5,686,999 | 11/1997 | Mizuno et al. | 347/116 |
| 5,701,170 | 12/1997 | Powers et al. | 355/85 |

*Primary Examiner*—Stephen R. Funk
*Attorney, Agent, or Firm*—Alix, Yale & Ristas, LLP

[57] ABSTRACT

A novel method and apparatus for the imaging of a continuous web on an internal drum type imaging device is disclosed. The method and apparatus may further be included in a process to produce punched, imaged sheets. A web is punched with registration holes and imaged in an internal drum-type imager prior to cutting the web into individual imaged plates particularly for use as printing plates. The web with an imageable surface is serially punched, imaged and sheeted with the punched holes being utilized to assure registration and alignment in the imaging operation and in the subsequent use of the plates on a printing press. The imaging station has an arcuate concave imaging platen. The web is advanced under tension and then stopped while a roller on an arm forces the web down into contact with the platen. Vacuum is then used to hold the web on the imaging platen while the web is imaged.

17 Claims, 7 Drawing Sheets

METHOD AND APPARATUS FOR PUNCHING AND IMAGING A CONTINUOUS WEB

The present invention relates to a method and apparatus for imaging a continuous web on an internal drum type imager. More particularly, in the preferred embodiment, it relates to a method and apparatus for punching registration holes in a web, imaging the web in an interior drum imager and subsequently cutting the imaged web into discrete lithographic printing plates. The present invention assures that the plates are imaged and cut with improved alignment and subsequent registration on the printing press.

BACKGROUND OF THE INVENTION

In the typical process for the formation of lithographic printing plates, the sensitized web of lithographic plate stock is cut into individual plates and stacked prior to imaging. The individual plates are optionally separated by individual sheets of interleaving paper where needed to protect the integrity of the coating. To image the plates, each individual plate is picked up from the stack, the interleaving paper is removed when present, and the plate is transferred to the imaging device. One common type of imaging device which is used is the internal drum type imager in which individual plates are held in position on the internal surface of the drum and imaged, usually by a laser. Typically, individual sheets or plates are loaded into the imaging drum either manually or with an automated plate handling system of some type. After positioning the plate in the imaging drum, vacuum is employed to hold the plate securely in place against the interior surface of the drum. Once the image is formed, the vacuum is released and the plate is removed from the imaging device. U.S. Pat. No. 5,619,246 discloses an apparatus for loading and unloading of individual plates into such an imaging device. Where punched plates are desired, the individual plates are optionally punched prior to or subsequent to the imaging process as a discrete, separate operation. Such prior art processes require considerable material handling equipment, precise alignment techniques and consume a lot of time. An imaged plate must be completely removed from the drum before the next plate can be loaded for imaging.

SUMMARY OF THE PRESENT INVENTION

The present invention relates to a novel method and apparatus for imaging a continuous web on an internal drum type imager. The invention may be incorporated as a part of a process and apparatus for the production of punched, imaged and sheeted printing plates. An object of the invention is to punch the web with registration holes and image the web in an internal drum imager prior to cutting the web into individual imaged plates. A web of material with an imageable surface is serially punched, imaged and sheeted (cut) in a continuous process. The web is advanced through the punching and imaging steps into a set of pull rolls and then passed to a sheeter where it is cut into discrete sheets. The punching and imaging may be performed at separate stations or at a single punching and imaging station. The punched holes are utilized to assure registration and alignment in the imaging and sheeting operations. The web is advanced under tension in a path running through an internal drum imager having an arcuate concave imaging platen. With the web held in position at one side of the drum, the web is moved to conform to and be held against the arcuate concave imaging platen and then imaged. The web is then pulled to the next imaging position and the steps repeated. After imaging, the imaged areas of the web are cut into individual plates. The present invention thus simplifies the process of obtaining finished, imaged sheets, by combining several discrete process steps into a continuous process. Further, the time required to image individual sheets is reduced since the present invention allows the imageable web to be loaded into the imaging device as the already imaged area of the web is being removed. Since all operations are controlled with improved precision, the subsequent alignment and registration of the finished plates is greatly improved.

DESCRIPTION OF THE PREFERRED EMBODIMENT

The present invention relates to the imaging of any suitable web with an imageable surface where the desired resultant article is discrete, imaged sheets. In the preferred embodiment, the web of material is suitable for the formation of printing plates. The web will typically be a grained, anodized aluminum stock having a sensitized coating which is imageable by exposure to actinic radiation in the infrared, visible or ultraviolet wavelength ranges in a manner well known to those skilled in the art. The invention is particularly suited for but not limited to lithographic printing plates.

Figure 1:
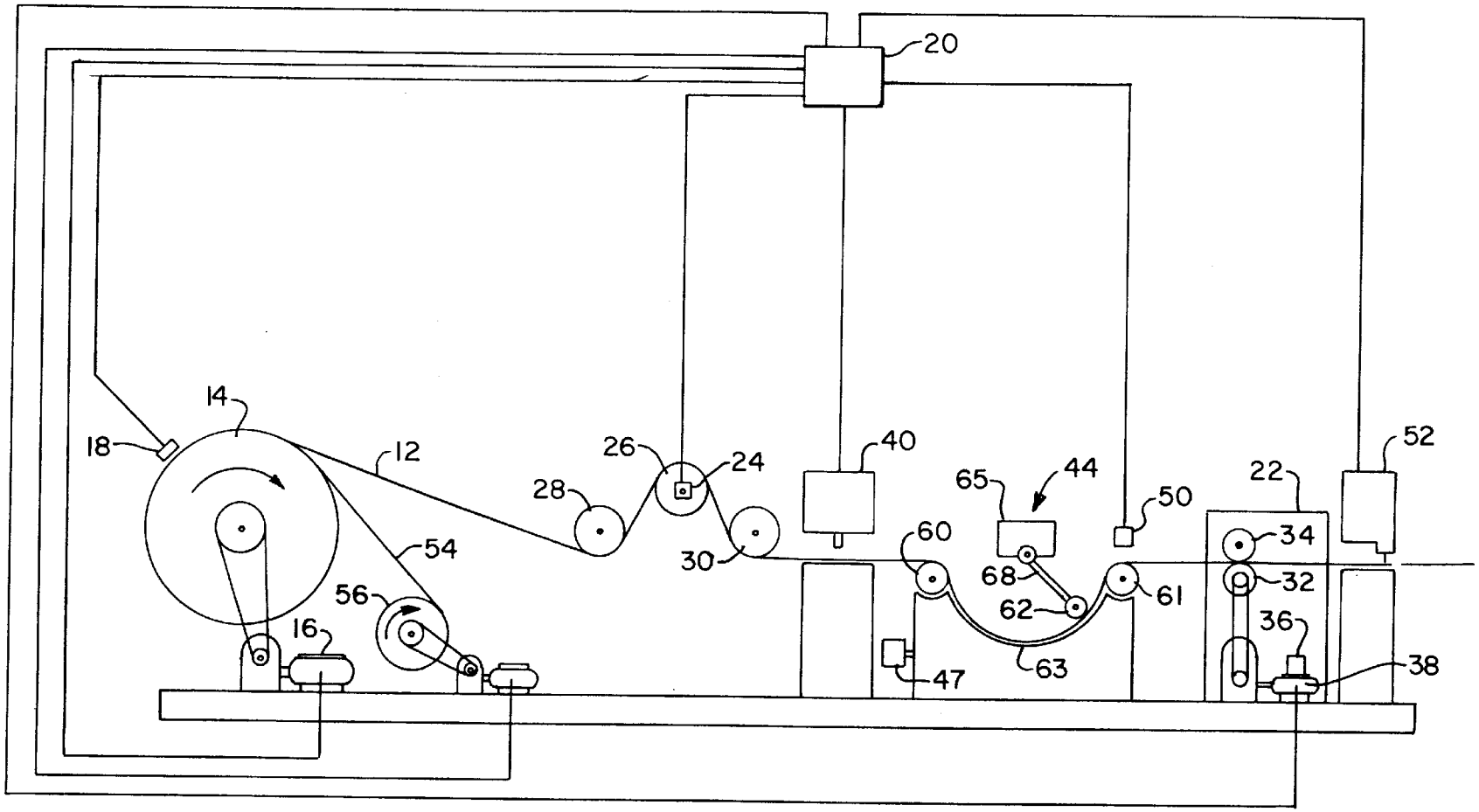
FIG. 1 is an illustration of a process line illustrating the method and the equipment for practicing the present invention.

FIG. 1 illustrates a web of imageable printing plate stock 12 coming off the unwind reel 14. The unwind reel 14 is driven by a controlled power source such as motor 16 with regenerative capabilities as known in the art. Such a device is capable of operating in reverse or of applying negative torque. A diameter sensing device 18 is used to provide a signal to the control system 20 representing the current diameter of the web on the unwind reel. Any suitably accurate distance-measuring device can be used. This diameter is required by the control system to accurately calculate the proper revolutions per minute of the unwind reel and thus control the speed of the motor 16 to set the proper web speed. The control system 20 is merely a conventional type of timing sequencing and calculating device to control the various functions of the entire process as discussed later.

Web tension is created by the pull roll system 22 providing a forward pull on the web and the unwind reel 14 providing the back tension through the motor 16. Web tension is sensed by a linear variable-differential transformer (LVDT) transducer or a strain gauge or similar known tension sensing device 24 associated with the roll 26. For example, the pillow blocks for the journals of the roll 26 can be mounted on the transducers which will then produce a signal proportioned to the force of the web on the roll 26 and thus proportional to the web tension. Rolls 28 and 30 maintain a constant angle of wrap of the web around the roll 26. The tension feedback signal from 24 is utilized by control system 20 to determine the proper control parameters of speed and torque for motor 16 thereby insuring that the proper web tension is maintained.

The primary control of the registration in the process line is the pull roll system 22. The pull roll system 22 consists of two feed rolls 32 and 34 that are ground to a precisely controlled diameter. An optical encoder 36 is mounted on the pull roll drive motor 38 or one of the pull rolls. The optical encoder 36 determines the length of the web as the web advances to the next position and will feedback the position to the control system 20. The feed rolls are conventional intermittently driven types of feed rolls which engage the web and intermittently move the web forward a predetermined distance equivalent to the size of one printing plate as set into the control system 20.

Figure 2:
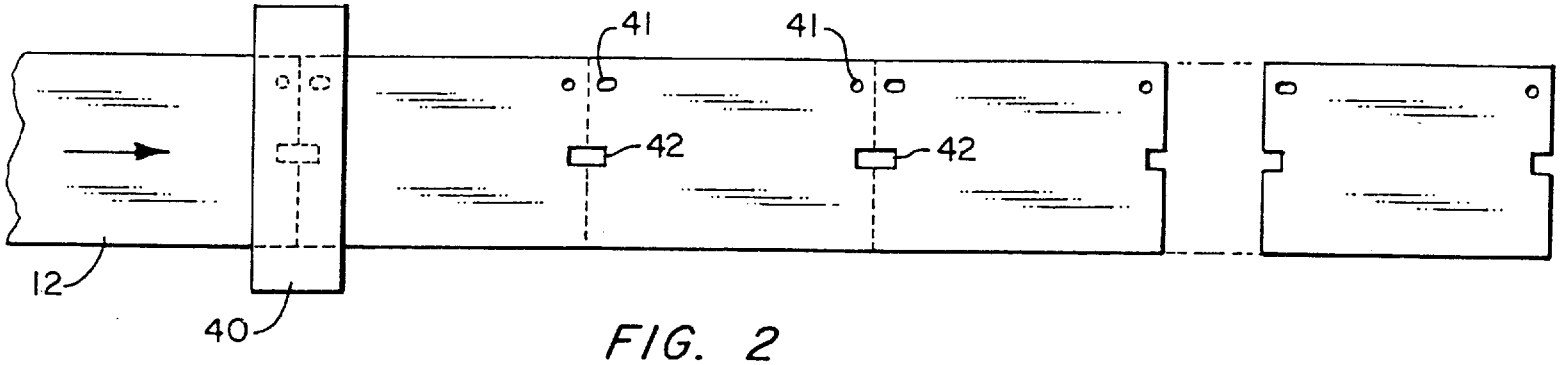
FIG. 2 is a top view of straight grain punched web according to the invention.
Figure 3:
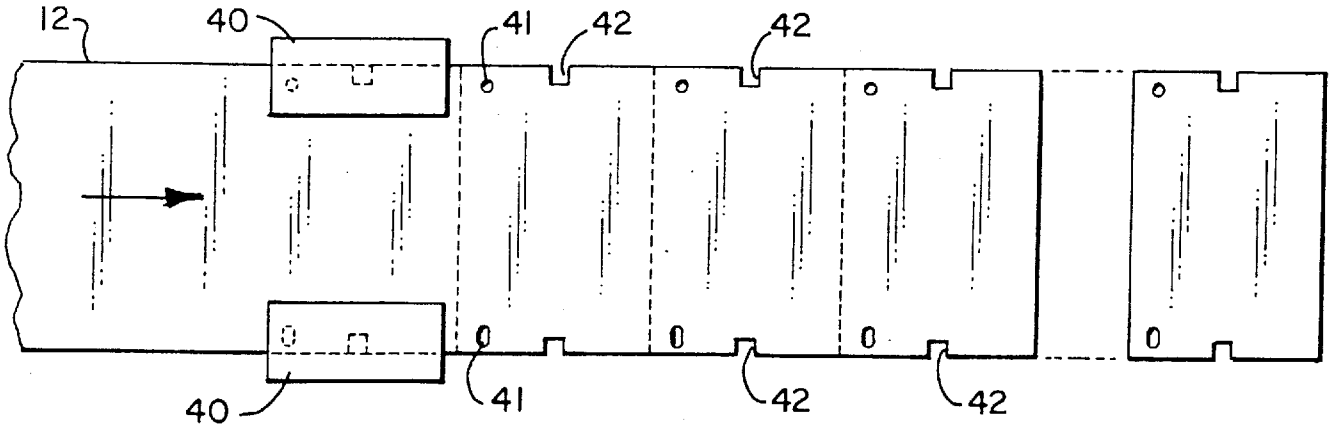
FIG. 3 is another top view of a punched web showing a cross grain form of punching.

Following the roll 30 is a punching mechanism 40 as known in the art for punching registration apertures in the web. Examples are the holes 41 and notches 42 as shown in FIGS. 2 and 3. These holes and notches may be of any desired configuration and they may be straight grain punches as shown in FIG. 2 (across the web) or cross grain punches as shown in FIG. 3 (lengthwise along the edges of the web). The notches 42 are representative of the apertures required for registration on the printing press while the holes 41 are typically used for registration in the equipment for forming the bend in the ends of the plates for mounting on the press cylinder. Since the registration notches and the bending holes, if required for bending, are pre-registered to the imaging system, the invention provides a very accurate registration system on press.

Figure 4:
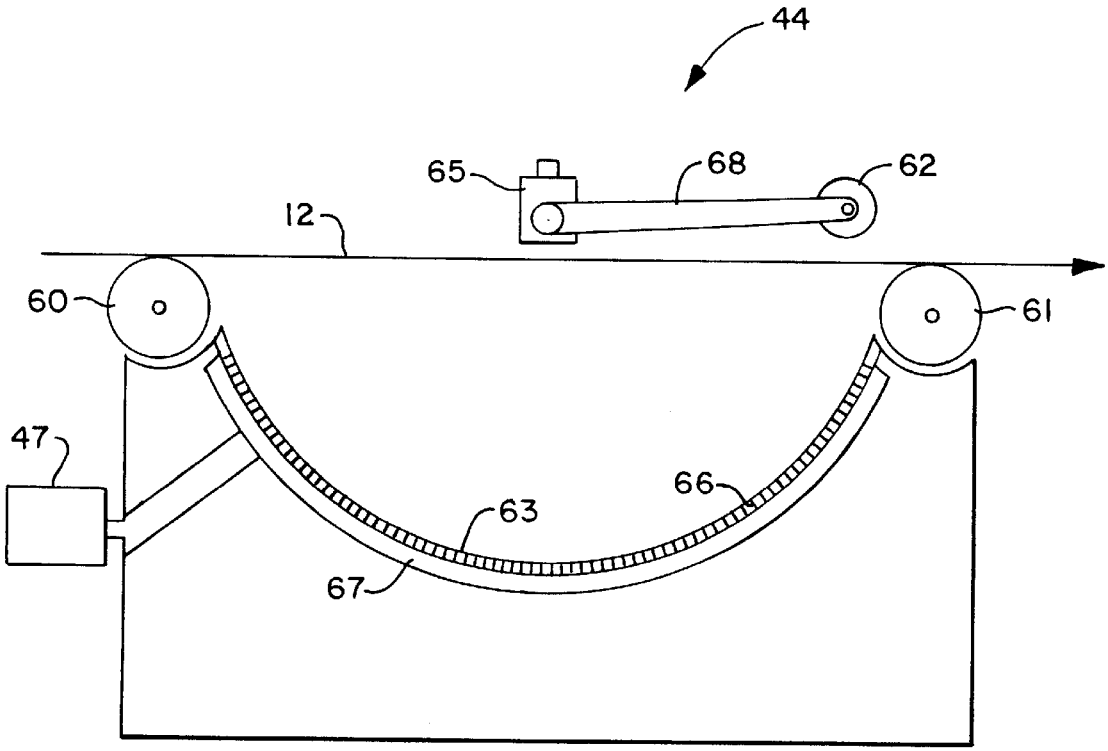
FIG. 4 is a detailed side view of the imaging station.
Figure 5:
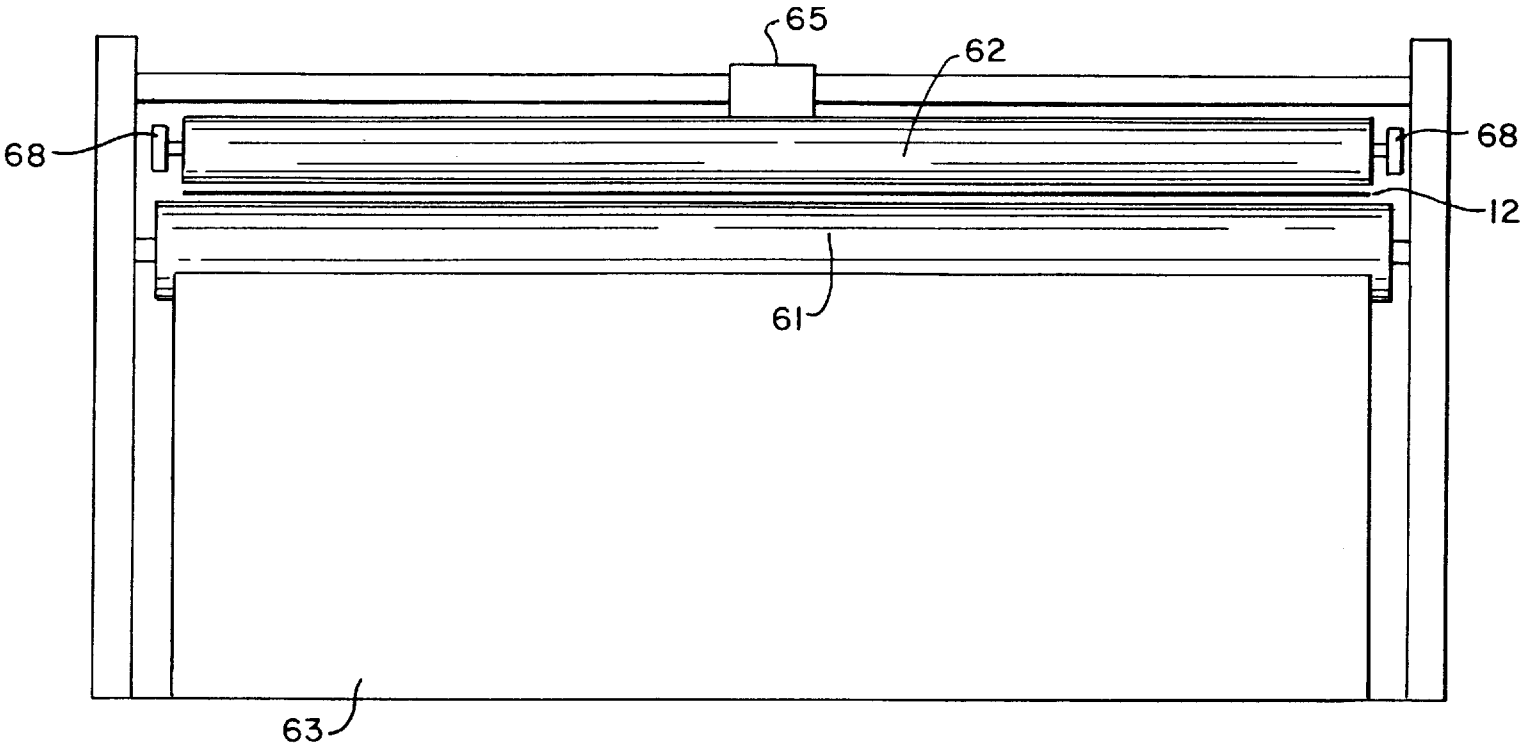
FIG. 5 is a front view of the imaging station viewing from the right in FIG. 4.

From the punching mechanism 40, the punched web is fed to the imaging station generally designated 44. As shown in FIGS. 1 and 4, this comprises an entrance roll 60, arcuate concave imaging platen 63, exit roll 61, positioning roll 62 mounted on arms 68 and a conventional laser imaging head 65. The rolls 60, 61 and 62 are of conventional design utilizing a steel core covered with a non-marking material such as a rubber compound. The arcuate concave imaging platen 63 has a series of pin holes 66 that are formed in the surface of the platen which connect to the vacuum chamber 67 and the vacuum pump 47.

Figure 6A:
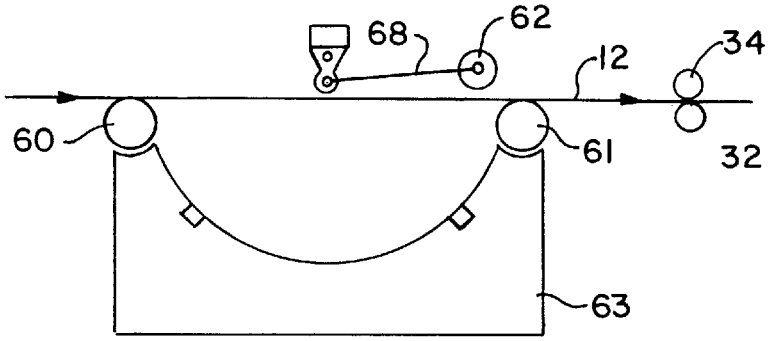
FIGS. 6A to 6D are illustrations of the imaging station and the various stages of positioning and holding the web on the arcuate concave platen.

The web 12 passes over the imaging chamber during the indexing cycle as illustrated in FIG. 6A. The web is stopped at the proper position by the position sensor 50, such as an optical sensor, which detects an appropriate punched hole 42. This can then provide for the indexing of the web to each successive position. The sensor 50 is ideally located at or close to the imaging station 44 to ensure the highest degree of accuracy in the imaging process. The control signal generated by the sensor 50 is used by the control system 20 to identify the web stopping position and stop the feed rolls to ensure the accurate position of the punched holes 42 in the imaging station 44. As a variation, the sensor can determine the actual position of the press registration apertures 42 and transmit that position to the control system 20. The control system then calculates the difference between the actual position of the apertures and the preset theoretical position. The calculated difference generates a datum line offset that is used by the control system to initiate the starting point for the laser imaging system in a known manner.

Figure 6B:
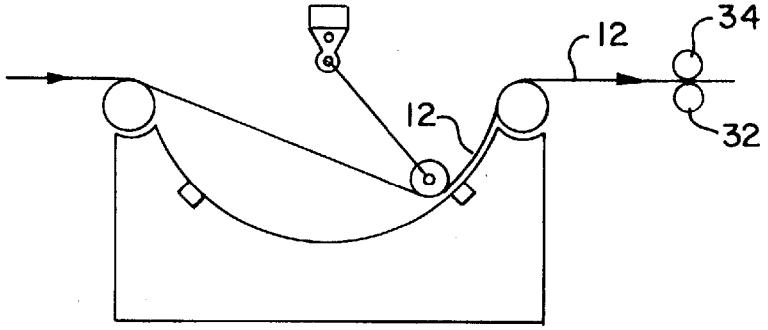
Figure 6C:
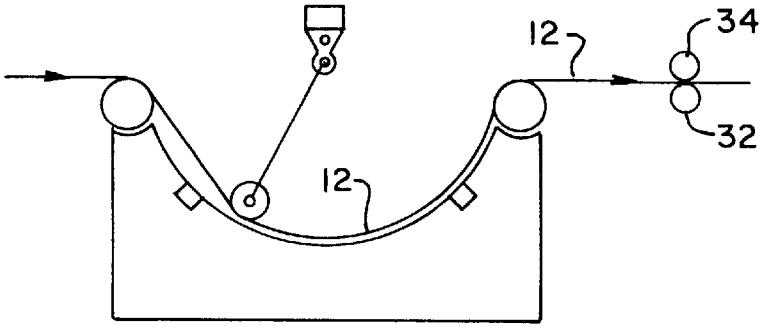
Figure 6D:
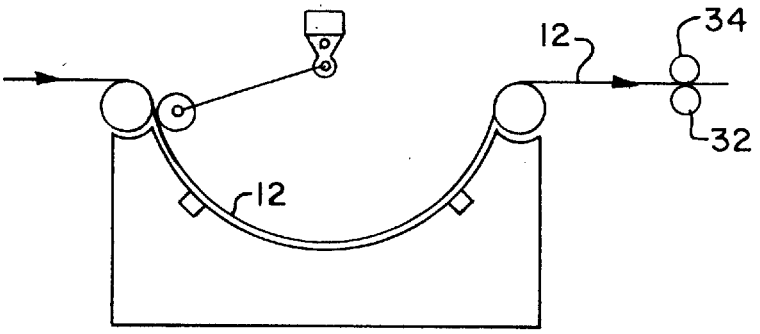

Upon completion of the indexing cycle, the leading end of the web 12 is held in a fixed position by the feed rollers 32 and 34 and the positioning roll 62 on the arms 68 begins to rotate in an arc parallel to the inner surface of the platen 63 pulling the web 12 from the supply reel 14 and forcing it into contact with the platen as illustrated in FIG. 6B. The roll 62 then continues in the arc as shown in FIGS. 6C and 6D until the web 12 is in contact with the entire platen. The movement of the positioning roll 62 is controlled by the control system 20. As the web comes in contact with the platen the vacuum is activated utilizing the vacuum pump 47 with sufficient vacuum pressure to secure the web in position on the platen.

The web is now in position and is imaged with the laser imager 65 or any other suitable means for imaging on a concave platen. Once imaged, the control system 20 causes the web to move forward to the next position and the process is repeated.

Following the pull roll system 22 is a shear device 52 which cuts the web into individual plates. The shear device 52 is also controlled by the controller 20 and is preferably located an exact distance from the position sensor 50 that is a multiple of the desired plate length. Since the accuracy of the shear cut-off length is determined by this distance, the cutter is preferably located as close to the feed rolls as practical to minimize any accumulative errors. After cutting, the plates can be sent to washing and bending stations which are not shown.

The imageable surface of the web 12 is on the upper surface as depicted in FIG. 1. Since the imageable surface is often a coating which should be protected, the web may be rolled together with an interleaving web of paper 54 which is located between each layer of the web 12 on the reel and protects the coating from the adjacent back-side of the web 12. As can be seen in FIG. 1, this paper web 54 is separated from the printing plate web 12 as it is unreeled. The paper web can then merely be rolled onto the spool 56 for disposal or reuse. The rotation of the spool 56 is controlled by the control unit 20.

The embodiment of the invention described thus far and shown in FIGS. 1, 4, 5 and 6 relates to an internal drum imager where the arc of the platen and the arc that is imaged is less than 180°. Since the imaging head 65 must be located at the center of curvature of the platen and since the web in this embodiment is pulled straight through the imaging station and since the web must be pulled through at a level between the imaging head and the platen, it is required that the web be pulled through at a level below the center of curvature. This results in the platen and the web on the platen being less than 180°.

Figure 7:
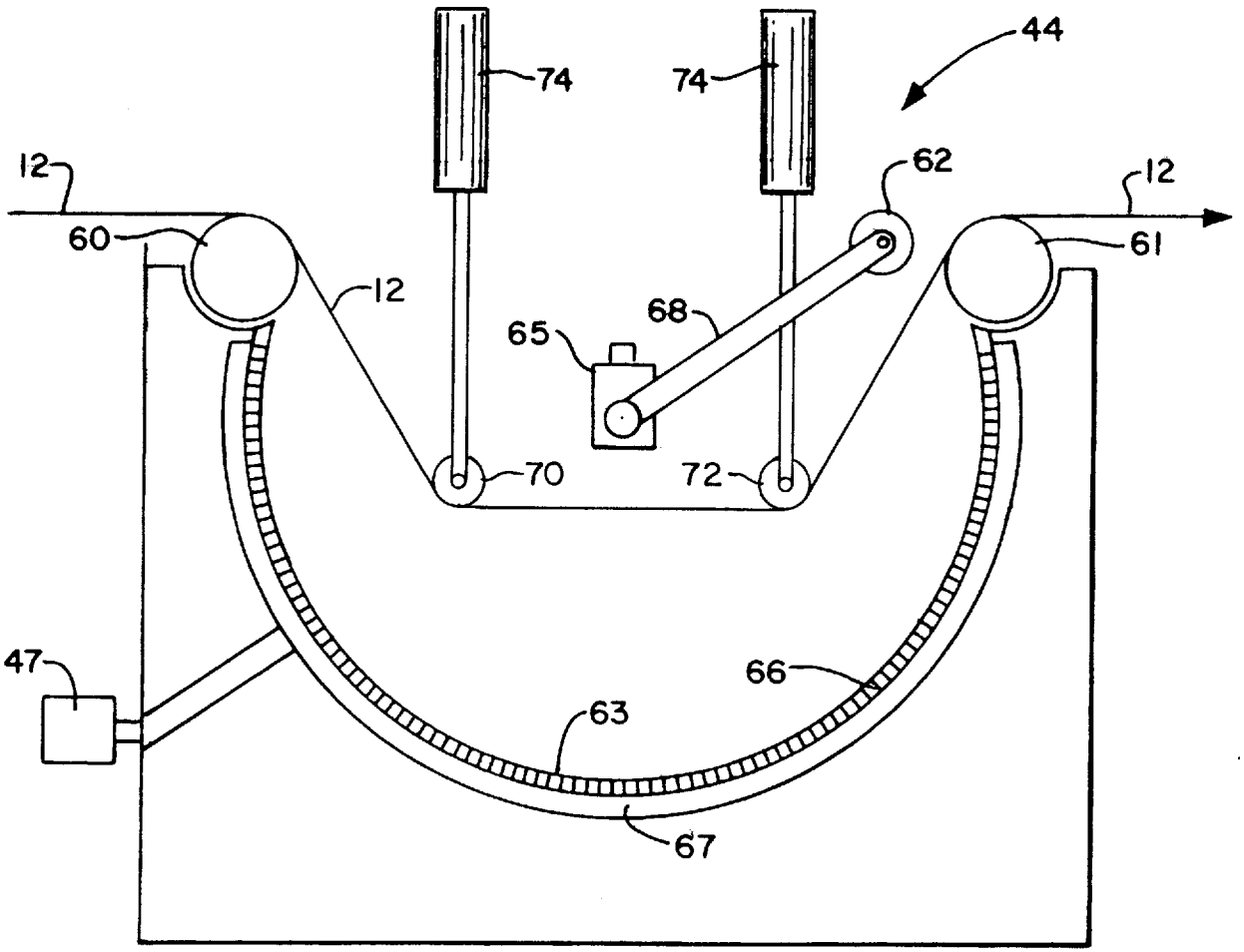
FIG. 7 is a detailed side view of an alternate embodiment of the imaging station.
Figure 8:
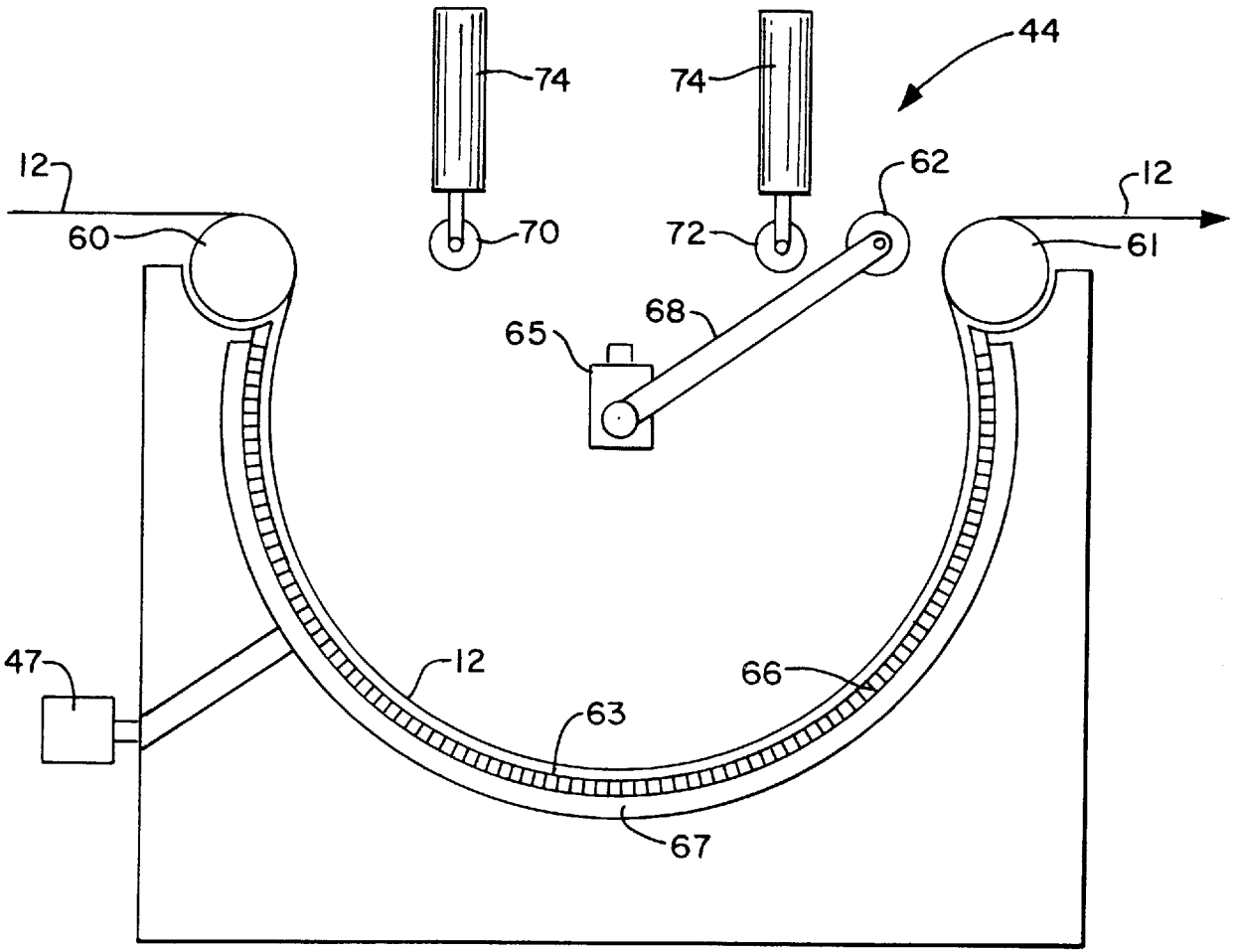
FIG. 8 is a detailed side view similar to FIG. 7 but ready for imaging.

The embodiment of the invention shown in FIG. 7 has a platen 63 which extends through an arc of more than 180°. In order to pull the web through the imaging station and have the web located between the imaging head 65 and the platen 63, guide rollers 70 and 72 are provided. These guide rollers 70 and 72 are mounted for vertical movement such as by the hydraulic cylinders 74. In FIG. 7, the guide rollers 70 and 72 are in the extended or lower position for pulling the web 12 through the imaging station 44. Once the web has been pulled to a position for imaging, the positioning roll 62 is activated to force the web 12 into contact with the platen 63 after which the vacuum is activated just as in the previous embodiment. Either before or after the web has been forced into contact with the platen, the guide rollers 70 and 72 are retracted or raised to the positions shown in FIG. 8. The positioning roll 62 has also been returned to its starting position such that all of the rolls 62, 70 and 72 are out of the imaging field or path. When the imaging step has been completed, the guide rolls 70 and 72 are lowered into the positions shown in FIG. 7 and the web is advanced to the next position.

There are a number of advantages of the present invention over the prior art. The punching, imaging and cutting are performed as a continuous operation instead of as individual, discrete processing steps. This eliminates the time and equipment for the handling of individual plates between each step. The time for imaging is reduced over the prior art since the web to be imaged can be fed into the imager as the already imaged region is being removed. Also, where interleaving paper is used, the cumbersome handling of individual interleaving sheets is replaced by a simple rewind device for a continuous web of paper.

An additional advantage lies in the fact that the punching, imaging and cutting are done in a way so as to assure alignment and registration with much greater precision than the prior art. By punching and indexing the process for the imaging and sheeting operations from the punched holes, the finished plates can be prepared with a greatly improved registration when mounted on a press, resulting in a reduction of losses on start-up of the press. This alleviates the need for the costly and time consuming optical bending as is currently often used in the printing industry for registration.

We claim:

1. Apparatus for serially punching and imaging an imageable continuous web material and subsequently cutting said web into separate individual plates of a desired length comprising:

a. web supply means;

b. punching means for punching registration holes in said web material at intervals corresponding to said desired plate length;

c. an imaging station following said punching means, said imaging station comprising:

i. an arcuate concave imaging platen, ii. guide means for guiding said web in a straight path through said imaging station spaced from said arcuate concave imaging platen, iii. means adapted to force said web from said straight path to a position conforming to said arcuate concave imaging platen, iv. vacuum means for holding said web in said position conforming to said arcuate concave imaging platen, and v. means for producing an image on the portion of said web conforming to said arcuate concave imaging platen;

d. cutting means following said imaging station for cutting said imaged web material into separate imaged plates of said desired length; and e. means for periodically advancing said continuous web material from said web supply means through said punching means and said imaging station and said cutting means in steps of said desired plate length and means for holding the leading end of said web in a fixed position while said web is forced into said conforming position and thereby pulled from said web supply means.

2. Apparatus as recited in claim 1 and further including means for positioning said web material in said imaging station comprising means for sensing said registration holes.

3. Apparatus as recited in claim 2 wherein said means for positioning said web material includes control means for activating and deactivating said means for periodically advancing said web in response to said means for sensing said registration holes.

4. Apparatus as recited in claim 3 wherein said means for sensing said registration holes is located in said imaging station.

5. Apparatus as recited in claim 1 wherein said means adapted to force said web to a position conforming to said arcuate concave imaging platen comprises roller means mounted on a pivot arm and adapted to swing in an arcuate path over the surface of said arcuate concave imaging platen and thereby force said web into contact with said arcuate concave imaging platen.

6. A method of forming individual printing plate images onto a continuous web of flexible printing plate stock containing an imageable surface thereon wherein said continuous web is wound on a supply reel comprising the steps of:

a. intermittently unwinding said web from said supply reel into a punching mechanism and punching holes at selected locations in said web;

b. intermittently passing said web from said punching mechanism and along a straight path into and through an imaging station having an arcuate concave imaging platen;

c. stopping said web in said imaging station and holding the leading end of said web;

d. forcing said web from said straight path to a position in contact with said platen and holding said web against said platen by vacuum;

e. imaging said web on said platen;

f. intermittently pulling said imaged web from said imaging station; and g. cutting said imaged web into individual printing plates.

7. A method as recited in claim 6 wherein said web is wound on said supply reel together with an interleaving protective web and comprising the step of removing said protective web onto a protective web reel as said web is unwinding from said supply reel.

8. A method of imaging individual printing plate areas on an elongated web of flexible printing plate stock containing an imageable surface wherein said imaging is performed in an imaging station having an arcuate concave imaging platen comprising the steps of:

a. extending said web in a path through a punching mechanism and in a straight path through said imaging station;

b. periodically pulling said web from the leading end stepwise along said path, each periodic stepwise movement moving said web to a desired position for punching registration holes and for imaging an individual printing plate area on said web;

c. stopping said web in said desired position while maintaining tension on said leading end of said web;

d. while said web is stopped, forcing said web from said straight path into contact with said platen;

e. while said web is stopped, punching said registration holes in one of said individual printing plate areas of said web and forming said image on the imageable surface of said web in said individual printing plate area of said web in contact with said platen;

f. moving said web to a next desired position and repeating steps c to e; and g. cutting said web between said individual printing plate areas thereby forming separate punched and imaged printing plates.

9. A method of forming individual printing plate images onto a continuous web of flexible printing plate stock containing an imageable surface thereon wherein said continuous web is wound on a supply reel comprising the steps of:

a. intermittently unwinding said web from said supply reel into and through an imaging station having an arcuate concave imaging platen along a path spaced from said platen;

b. stopping said web in said imaging station and holding the leading end of said web;

c. forcing said web from said path to a position in contact with said platen and holding said web against said platen by vacuum;

d. imaging said web on said platen;

e. intermittently pulling said imaged web from said imaging station; and f. cutting said imaged web into individual printing plates.

10. A method as recited in claim 9 wherein said web is wound on said supply reel together with an interleaving protective web and comprising the step of removing said protective web onto a protective web reel as said web is unwinding from said supply reel.

11. A method as recited in claim 9 wherein said path is a straight path and said step of imaging said web comprises imaging less than 180°.

12. A method as recited in claim 9 wherein said imaging station includes an imaging device and wherein said path extends downwardly from a position above said imaging device around said imaging device back up to a position above said imaging device and wherein said step of imaging said web comprises imaging more than 180°.

13. A method of imaging individual printing plate areas on an elongated web of flexible printing plate stock containing an imageable surface wherein said imaging is performed in an imaging station having an arcuate concave imaging platen comprising the steps of:

a. extending said web in a path through a punching mechanism and in a straight path through said imaging station;

b. periodically pulling said web from the leading end stepwise along said path, each periodic stepwise movement moving said web to a desired position for punching registration holes and for imaging an individual printing plate area on said web;

c. stopping said web in said desired position while maintaining tension on said leading end of said web;

d. while said web is stopped, forcing said web from said straight path into contact with said platen;

e. while said web is stopped, punching said registration holes in one of said individual printing plate areas of said web and forming said image on the imageable surface of said web in said individual printing plate area of said web in contact with said platen;

f. moving said web to a next desired position and repeating steps c to e; and g. cutting said web between said individual printing plate areas thereby forming separate punched and imaged printing plates.

14. Apparatus for serially imaging an imageable continuous web material with images of a desired web length comprising:

a. web supply means;

b. an imaging station comprising:

i. an arcuate concave imaging platen, ii. guide means for guiding said web in a path through said imaging station spaced from said arcuate concave imaging platen, iii. means adapted to force said web from said path to a position conforming to said arcuate concave imaging platen, iv. vacuum means for holding said web in said position conforming to said arcuate concave imaging platen, and v. means for producing an image on the portion of said web conforming to said arcuate concave imaging platen; and c. means for periodically advancing said continuous web material from said web supply means through said imaging station in steps of said desired web length and means for holding the leading end of said web in a fixed position while said web is forced into said conforming position and thereby pulled from said web supply means.

15. Apparatus as recited in claim 14 wherein said arcuate concave imaging platen extends through an arc of less than 180° and wherein said path through said imaging station is a straight path between said imaging device and said arcuate concave imaging platen.

16. Apparatus as recited in claim 14 wherein said arcuate concave imaging platen extends through an arc of more than 180° and wherein said path through said imaging station extends around said imaging device and between said imaging device and said arcuate concave imaging platen.

17. Apparatus as recited in claim 16 wherein said guide means for guiding said web around said imaging device comprises guides which are extendable into a position between said imaging device and said arcuate concave imaging platen for guiding said web in said path and which are retractable into a position which is not between said imaging device and said arcuate concave imaging platen.

* * * * *